US006206495B1

(12) United States Patent
Peterson

(10) Patent No.: US 6,206,495 B1
(45) Date of Patent: Mar. 27, 2001

(54) DOCK AND ROLL MOBILE COMPUTER STAND WITH ADJUSTABLE KEYBOARD TRAY

(76) Inventor: Graham Peterson, 19 Hooper Creek Rd., Tryon, NC (US) 28782

( * ) Notice: Subject to any disclaimer, the term of this patent is extended or adjusted under 35 U.S.C. 154(b) by 0 days.

(21) Appl. No.: 09/426,625

(22) Filed: Oct. 26, 1999

Related U.S. Application Data

(60) Provisional application No. 60/105,543, filed on Oct. 26, 1998.

(51) Int. Cl.[7] ..... A47B 81/06

(52) U.S. Cl. ..... 312/283; 312/302; 312/322; 312/249.13

(58) Field of Search ..... 312/283, 281, 312/308, 310, 311, 302, 249.8, 249.11, 249.12, 249.13, 322; 108/139, 140; 280/47.34, 47.35

(56) References Cited

U.S. PATENT DOCUMENTS

| | | | | |
|---|---|---|---|---|
| 136,525 | * | 3/1873 | Kirchner | 312/302 X |
| 967,783 | * | 8/1910 | Kellogg | 312/283 |
| 1,010,950 | * | 12/1911 | Prather | 312/322 X |
| 1,084,211 | * | 1/1914 | Hunter | 312/322 X |
| 1,406,129 | * | 2/1922 | Woltz | 312/302 X |
| 1,592,443 | * | 7/1926 | Comstock | 312/283 |
| 2,037,919 | * | 4/1936 | Poe | 312/322 X |
| 2,200,919 | * | 5/1940 | Fritch | 312/302 X |
| 2,293,496 | * | 8/1942 | Egger | 312/322 X |
| 2,605,153 | * | 7/1952 | Lietz | 312/322 X |
| 2,650,871 | * | 9/1953 | Holderegger | 312/322 |
| 2,680,314 | * | 6/1954 | Snyder | 108/140 X |
| 4,844,388 | | 7/1989 | Kuba et al. . | |
| 5,145,136 | | 9/1992 | McConnell | 248/284.1 |
| 5,772,292 | | 6/1998 | Touzani et al. | 312/208.1 |
| 5,797,666 | | 8/1998 | Park | 312/319.5 |
| 5,803,562 | | 9/1998 | Jacobs et al. | 312/283 |
| 5,839,373 | | 11/1998 | Lin | 108/140 |
| 5,881,984 | | 3/1999 | Lin | 248/284.1 |
| 5,901,933 | | 5/1999 | Lin | 248/285.1 |
| 5,913,582 | | 6/1999 | Coonan | 312/223.3 |

FOREIGN PATENT DOCUMENTS

| | | | | |
|---|---|---|---|---|
| 926443 | * | 4/1955 | (DE) | 312/322 |
| 1225442 | * | 6/1960 | (FR) | 312/322 |

* cited by examiner

*Primary Examiner*—James O. Hansen
(74) *Attorney, Agent, or Firm*—Flint & Kim, P.A.

(57) ABSTRACT

A portable utility stand for computer equipment and the like is disclosed which comprises a cabinet having a front, rear, and sides. A main compartment is disposed in a lower part of the cabinet and an auxiliary compartment is disposed in an upper part of the cabinet above the main compartment. A support tray assembly is carried in the auxiliary compartment which includes a slidable base. A utility tray for supporting a keyboard rotatably is carried by the slidable base so that the tray rotates on the base. The utility tray has a stored position wherein the tray and base are generally longitudinally aligned and are received longitudinally in the auxiliary compartment, and an operational position wherein the tray is withdrawn from the compartment and oriented at a desired angle relative to the base for keyboard operation.

16 Claims, 3 Drawing Sheets

DOCK AND ROLL MOBILE COMPUTER STAND WITH ADJUSTABLE KEYBOARD TRAY

This application claims the benefit of provisional application serial No. 60/105,543, filed Oct. 26, 1998.

BACKGROUND OF THE INVENTION

This invention relates to a utility stand, more particularly to a compact, mobile computer stand having a small footprint in which all the necessary computer equipment may be stored and/or rolled for mobility, and a unique, adjustable keyboard tray assembly.

With more and more homes and offices being equipped with computer equipment, the problem of providing a small compact computer stand occupying a small footprint yet which will accommodate all the computer and peripheral equipment is a problem to which considerable attention need be given. Heretofore, various computer tables, desks, hutches and mobile stands have been provided. However, these devices have lacked the utility and versatility for accommodating all of the computer equipment and peripheral equipment in a compact manner with a stand which has a small footprint yet is versatile.

Keyboard trays have typically been shelves. The keyboard is carried on the shelf which slides in and out of a computer desk. Numerous adjusting mechanisms for keyboard shelves are illustrated in U.S. Pat. Nos. 5,901,933; 5,881,984; 5,839,373; 5,145,136; and 4,844,388. While these devices are suitable for computer desks and the like, they are relatively complex mechanisms and do not provide a wide variety of keyboard positionings as disposed within a compact arrangement. U.S. Pat. Nos. 5,913,582, 5,772,292, 5,797,666, and 5,803,562 show various keyboard and computer stands of general interest. However these stands are relatively complicated having a large number of parts, and are not suitable for compact, small footprint stands requiring only a small space.

Accordingly, an object of the present invention is to provide a compact mobile computer stand with adjustable keyboard tray having a small footprint so it is portable and/or may be used along side other office furniture.

Another object of the invention is to provide a keyboard tray assembly which is compactly foldable yet has a wide range of operational positions.

Another object of the invention is to provide a stand in which computer equipment may be docked or rolled so that it is highly portable and may be used throughout an office or home.

Yet another object of the invention is to provide a highly mobile and compact computer stand in which computer equipment may be docked or rolled about to a desired location where the stand may be opened to provide for additional shelf space for accessory equipment.

SUMMARY OF THE INVENTION

The above objectives are accomplished according to the present invention by providing a portable utility stand for computer equipment and the like comprising a stand having a pair of spaced opposed sides. A support tray assembly is carried by the stand between the sides for supporting a computer keyboard. A slidable base is included in the tray assembly which slides relative to the stand. A utility tray supports the keyboard and is rotatably carried by the slidable base so that the tray rotates on the base. The utility tray has a stored position wherein the tray and base are generally longitudinally aligned and are received longitudinally in the stand, and an operational position wherein the tray is withdrawn from the stored position and oriented at a desired angle relative to the base for keyboard operation. A mount is constructed and arranged to mount the tray on the base in a manner that the tray and base swivel and move in a straight-line relative to each other. Preferably, the tray includes a keyboard section for supporting a computer keyboard, and a mouse pad section for supporting a computer mouse. The mount positions the tray in a right-hand operational position wherein the mouse pad section is offset to the right side of the keyboard section. Alternately, the mount positions the tray in a left-hand operational position which is rotated 180 degrees from the right-hand operational position wherein the mouse pad section is offset to the left of the keyboard section.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
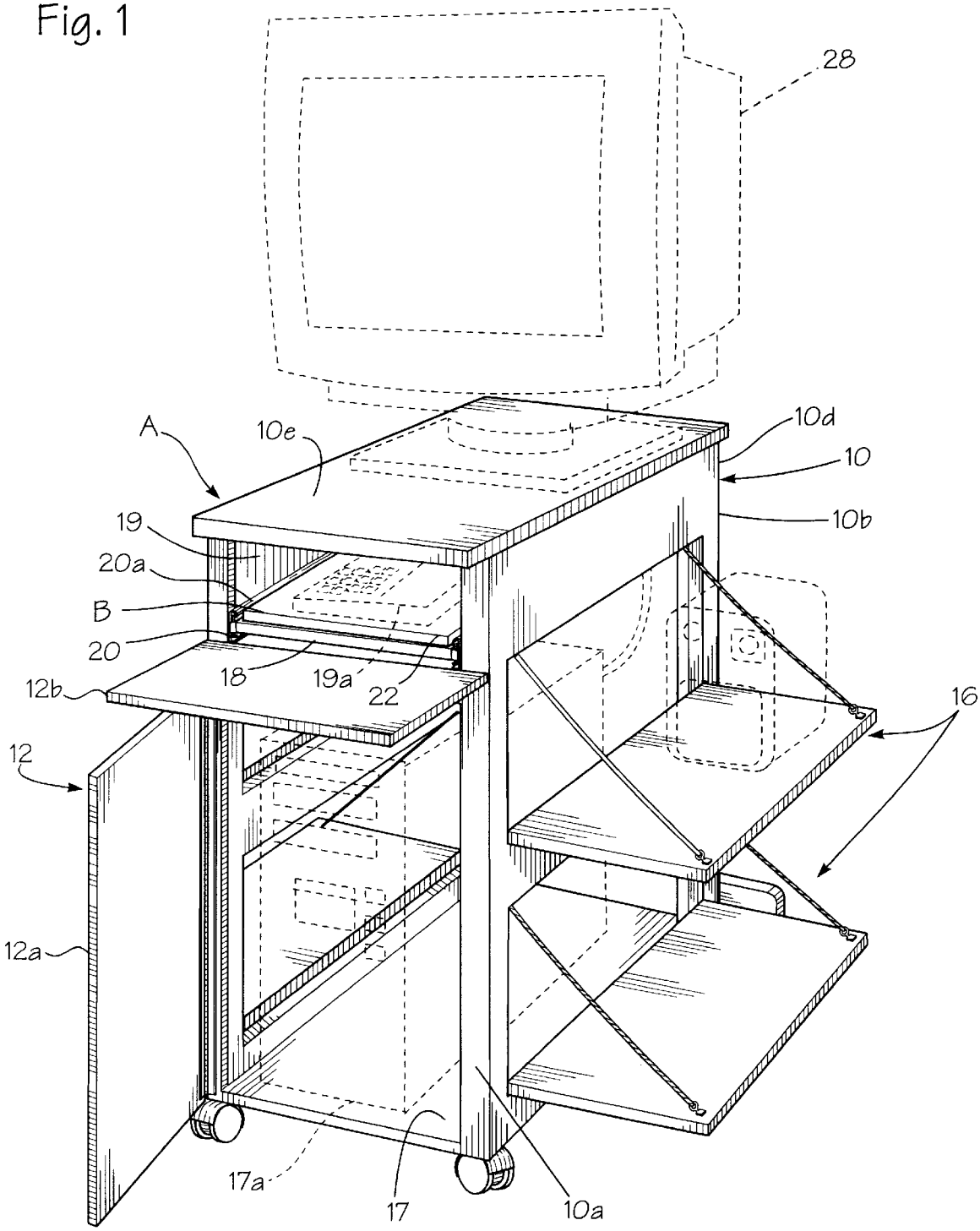
FIG. 1 is a perspective view of a compact portable computer cabinet and keyboard tray assembly according to the invention.

Referring now to the drawings, an illustrated embodiment of the invention will be described in more detail.

As can best be seen in FIG. 1, a utility stand, designated generally as A, is provided for use as a mobile computer stand, and the like, with an adjustable keyboard tray assembly B. The stand includes a cabinet 10 which, in the illustrated embodiment, has a slender, upstanding rectangular appearance much like that of a computer tower, and includes a front 10*a*, a pair of opposed sides 10*b* and 10*c*, a rear 10*d*, and top 10*e*. In a closed configuration, the housing includes a front door 12 which is closed, and a pair of side shelves 14 and 16 on sides 10*b* and 10*c* of the cabinet which are folded up. The side shelves have a folded-up configuration when the stand is rolled or unused, and have an open horizontal configuration for placement of accessories when open and docked where the stand is to be used. Preferably, the front door, designated generally as 12, includes a main door 12*a* for access to a main compartment 17 in which a computer tower 17*a* is placed. Door 12 may also include a keyboard door 12*b* which provides access to an auxiliary keyboard storage compartment 19 in which a keyboard tray assembly B, and keyboard 19*a*, may be received for storage and withdrawn for use. Preferably keyboard door 12*b* pivots down when keyboard tray assembly B is in an operational position. The keyboard tray assembly includes a sliding base 18 which is carried on a telescoping drawer slide 20 and a substantially planar keyboard tray 22 which is slidably carried by base 18 so as to slide in longitudinal alignment with respect to base 18, and swivel.

Figure 2A:
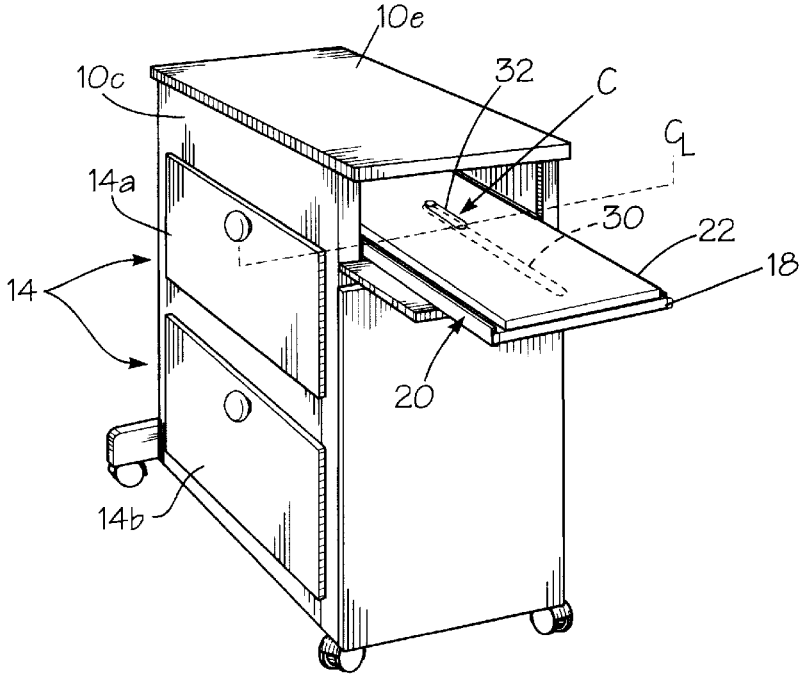
FIG. 2A is a perspective view of a compact portable computer cabinet and keyboard tray assembly according to the invention with the keyboard tray assembly in a partially withdrawn configuration.
Figure 2B:
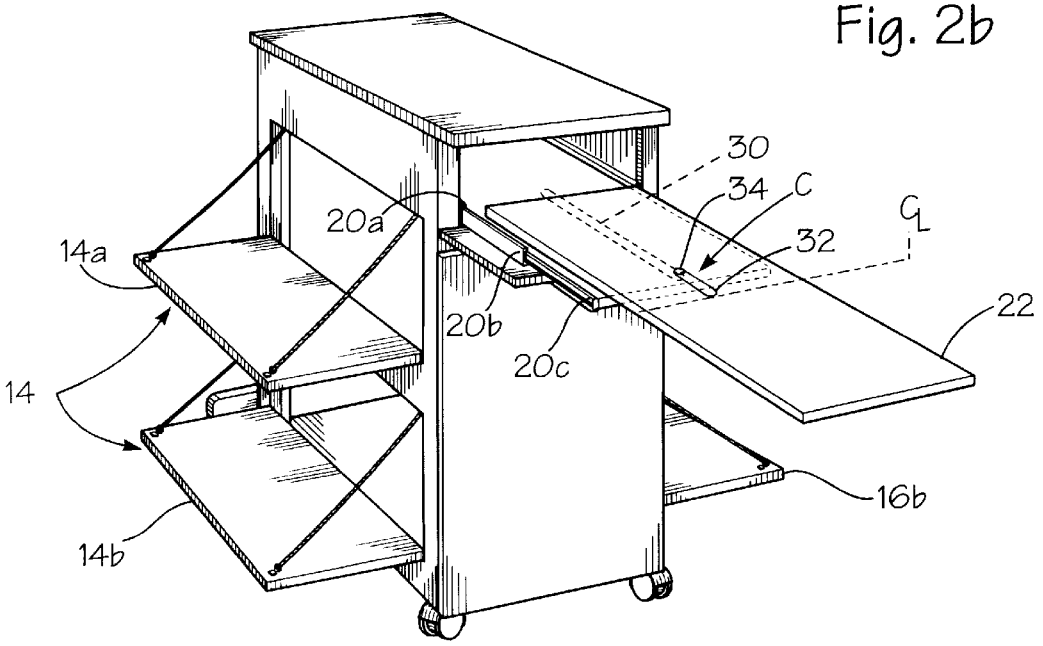
FIG. 2B is a perspective view of a compact portable computer cabinet and keyboard tray assembly according to the invention with the keyboard tray assembly fully withdrawn.
Figure 3:
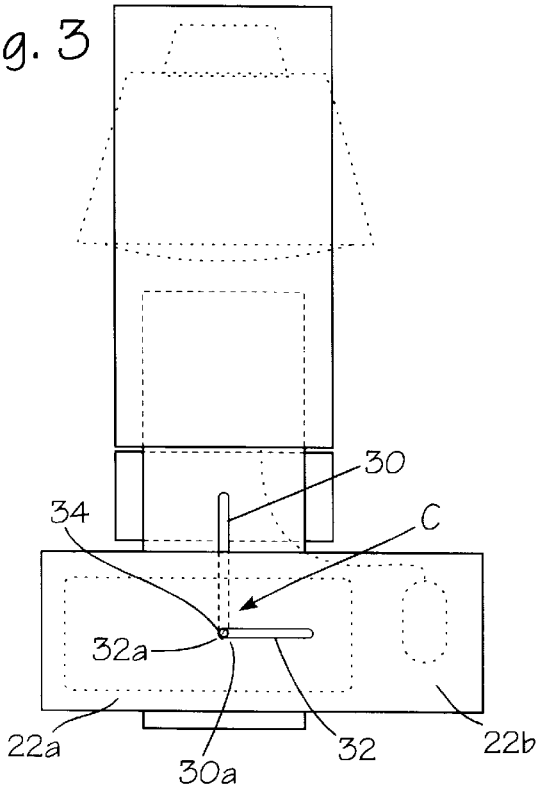
FIG. 3 is a top plan view of a compact portable computer cabinet and keyboard tray assembly according to the invention with the keyboard tray in a righthand operational position.
Figure 4:
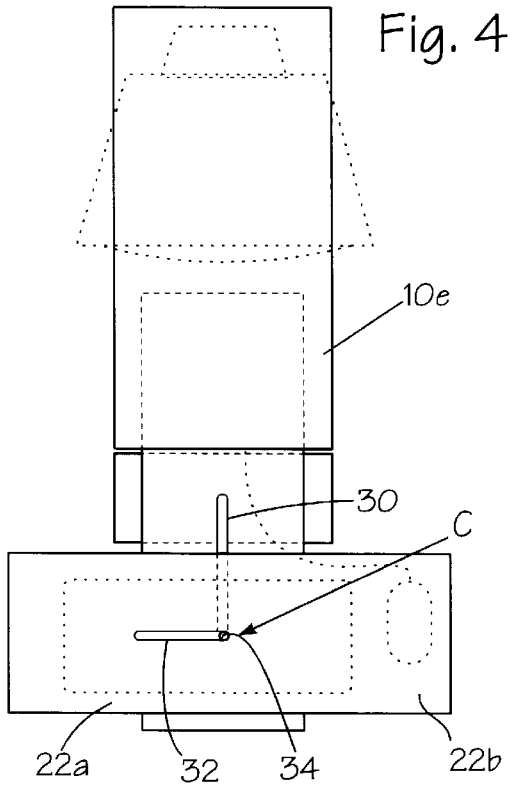
FIG. 4 is a top plan view of a compact portable computer cabinet and keyboard tray assembly according to the invention with the keyboard tray in a centered position.
Figure 5:
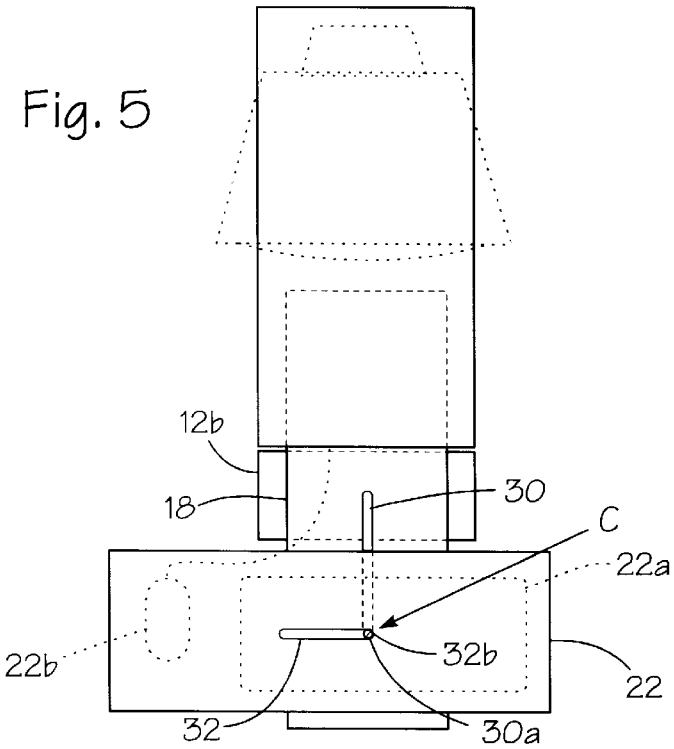
FIG. 5 is a top plan view of a compact portable computer cabinet and keyboard tray assembly according to the invention with the keyboard in a lefthand operational position.

It will be noted in FIG. 2*a*, 2*b* that keyboard tray 22 is pivotally mounted to base 20 by a mount, designated generally as C, which allows straight-line and rotational movement. Keyboard tray 22 has a keyboard section 22*a* and a mouse pad section 22*b* which is offset relative to the center of the tray. Keyboard tray 22 is mounted off center so that it can swivel to a right hand position (FIG. 3), or a left hand position (FIG. 5) to accommodate mouse operation by a left handed or right handed computer operator. A center position is illustrated in FIG. 4. Most important, it will be noted that keyboard tray 22 may swivel 90 degrees to a storage position wherein it may be received lengthwise in the keyboard compartment 19 of the cabinet. Thus, with base 20 extended, keyboard tray 22 may swivel 180 degrees between the left and right hand operational positions, or any position there between, as desired by the operator. Keyboard door 12*b* is folded downwardly in use, and main door 12*a* may be closed at all times so that the computer tower, or other equipment, is concealed in the stand.

Drawer slide 20 may be any conventional telescoping door slide having a first section 20*a* affixed to the interiors of cabinet sides 10*b* and 10*c* within keyboard compartment 19. There is a first slide section 20*b* received within fixed section 20*a*, and a second slide section 20*c* affixed to base 18 (FIG. 2*b*). Thus, keyboard tray 22 is uniquely carried on a drawer slide so it can be turned sideways and recessed completely out of view lengthwise in the middle of the stand when not in use. The drop down, keyboard door can then be closed and locked if desired. The mouse pad section 22*b* is designed to be an extension of the keyboard tray. The keyboard tray is designed to swivel on the drawer slide base 180 degrees to accommodate a left or right handed computer operator. The swivel feature also allows the angle of the keyboard to be set facing any direction depending on the position of the keyboard operator in relation to his or her work area.

Mount C for slidably and rotatably mounting keyboard tray 22 to base 18 includes, in the illustrated embodiment, a base slot 30 formed in base 18 which is longitudinally in line with the base and is elongated. There is a tray slot 32 also longitudinally aligned and formed in tray 22. A common fastener may be provided in the form of a pin 34 which may be a bolt with a recessed head mounted in slot 32 with a nut on the opposing end. By means, pin 34 may slide the axial length of slot 30 so that tray 22 slides on base 18 as base 18 slides on drawer slide 20. Thus, when tray assembly B is in the stored position of FIG. 1, both base 18 and tray 22 are slid rearwardly to lie generally flush and coextensive with each other. When the keyboard tray assembly is withdrawn to its operational position of FIG. 2*b*, pin 34 is generally at an end of base slot 30. In the position of FIG. 2*b*, tray 22 may be rotated 90 degrees to the right hand operational position of FIG. 3 wherein pin 34 is at a left end 32*a* of slot 32 and at a forward end 30*a* of base slot 30. In this position, mouse pad section 22*b* is offset to the right of the middle of base 18. Alternately, keyboard tray 22 may be slid to the left so that pin 34 is at the right end 32*b* of tray slot 32 and also at the forward end 30*a* of base slot 30, as can best be seen in FIG. 5. In this position, mouse pad section 22*b* is offset to the left of the mid-line of base 18. A third operation position may be provided with the keyboard tray 22 centered relative to base 18, as shown in FIG. 4. In addition, keyboard tray 22 may be rotated to intermediate positions where the tray is at an angle to base 30 other than 90 degrees as is desired by the user for comfort and convenience. Thus it can be seen that a highly versatile keyboard tray assembly can be had according to the invention which may be used in the cabinet of the invention as well as other desk, work station, or associated structure.

Lower, storage compartment 17 of the stand is designed to accommodate a typical tower CPU unit 17*a*. It may be accessed by the main front door and the rear of the cabinet. A monitor 28 may be supported on top 10*c* of the cabinet. The depth of the cabinet is designed long enough to accommodate and hide the connecting cables and plugs that extend from the rear of a computer. A power strip (not shown) for multiple electrical plugs may be included on the floor of the CPU compartment. This allows a much cleaner look in the rear of the computer without all the typical plugs and cables generally associated with computer hookups lying on the floor next to the stand. Instead, the plugs and cables are enclosed within the stand. Only a single power cord need go into the stand to power the power strip.

The pairs of side shelves 14, 16 will now be described. The pair of side shelves 14 includes a first drop down shelf 14*a*, and a second drop down shelf 14*b*. Pair 16 of side shelves includes a first drop down shelf 16*a*, and a second drop down shelf 16*b*. The shelves may be hinged and supported in any suitable manner. As illustrated, the shelves are supported by flexible chains 28 and are pivoted on conventional shelf or piano hinges (not shown). With the portable stand docked, the shelves may be opened to support miscellaneous computer accessories, speakers, components, disk storage devices, etc. Alternately, these shelves can remain in their closed, folded-up position to minimize the floor area covered by this unit and/or to provide a clean overall appearance. Optional shelves can also be inserted in the CPU compartment to allow the unit to be used with a lap top computer, or as a general utility cart.

Top 10*e* is designed to accommodate a typical computer monitor with the design to be approximately the width of the base of the computer monitor, the depth of the top allows a monitor to be positioned as close or as far away as desired by the operator. The extended length of the drawer slide base 18 also allows the keyboard user to position the keyboard tray 22 as close or as far away from the unit as desired. In one example, the cabinet is 11 inches wide, 25 inches deep, and 29 inches high. For portability, front and rear castors 40 are provided, and a transverse leg 42 is provided to carry the rear castors which is widened to enhance stability. The rear of the cabinet may include rear access doors (not shown) for access to the computer and wiring. For this purpose, a power strip may be mounted inside the rear door so that only a single cord is needed outside the cabinet.

Thus it can be seen that an advantageous construction can be had for a compact cabinet for computers and the like wherein a versatile keyboard assembly may be stored and withdrawn for use wherein the overall configuration has a small footprint that can be used alongside or with other equipment. While the unique keyboard tray assembly is shown in combination with the cabinet where its features are particularly advantageous, it may also be used with desks and other work stations. For this purpose, the drawer slide mount may be attached to any associated structure of the work station.

While a preferred embodiment of the invention has been described using specific terms, such description is for illustrative purposes only, and it is to be understood that changes and variations may be made without departing from the spirit or scope of the following claims.

What is claimed is:

1. A portable utility stand for computer equipment comprising:

a cabinet having a front, a rear, and a pair of sides;

a main compartment adapted to receive a computer tower disposed in a lower part of said cabinet;

an auxiliary compartment disposed in an upper part of said cabinet above said main compartment;

a tray door for enclosing said auxiliary compartment;

a support tray assembly carried in said auxiliary compartment which includes a slidable base;

a keyboard tray for supporting a keyboard rotatably carried by said slidable base so that said keyboard tray rotates on said base;

said keyboard tray having a stored position wherein said keyboard tray and base are generally longitudinally aligned and received through said front within said auxiliary compartment behind said auxiliary door, and an operational position wherein said keyboard tray is withdrawn through said front from said auxiliary compartment, over said auxiliary door and oriented in a generally horizontal position generally transverse of said base for keyboard operation.

2. The stand of claim 1 including a mount constructed and arranged to mount said keyboard tray on said base in a manner that said keyboard tray and base swivel move in a straight-line relative to each other.

3. The stand of claim 2 wherein said keyboard tray includes a keyboard section for supporting a computer keyboard, and a mouse pad section for supporting a computer mouse; and said mount positioning said keyboard tray in a right-hand operational position wherein said mouse pad section is on the right side of said keyboard section, and said mount positioning said tray in a left-hand operational position which is rotated 180 degrees from said right-hand operational position wherein said mouse pad section is on the left of said keyboard section.

4. The stand of claim 2 wherein said mount includes a first mount member which mounts said keyboard tray and base for relative straight-line movement and a second mount member which mounts said keyboard tray and base for relative rotational movement.

5. The stand of claim 4 wherein said first mount member includes an elongated slot formed in one of said keyboard tray and base and said second mount member includes a swivel pin interconnecting said keyboard tray and base which is received in said elongated slot so that said keyboard tray and base move in said straight-line and rotational movements.

6. The stand of claim 5 wherein said slot is a base slot formed longitudinally in said base.

7. The stand of claim 6 including a tray slot formed in said keyboard tray, said swivel pin being received in said base and tray slots, and said base and tray slots being generally longitudinally aligned when said base and keyboard tray are in said stored position and said base and tray slots are inclined when said base and keyboard tray are in said operational position.

8. The device of claim 1 including a main door enclosing said main compartment of said cabinet.

9. The device of claim 8 wherein said tray door includes a drop down panel pivotally carried by said cabinet having a drop down position in which said panel is disposed generally horizontal when said keyboard tray is in said operational position.

10. The device of claim 1 including foldable side shelves carried by said sides of said cabinet having a drop down position when said cabinet is operational.

11. The device of claim 1 wherein said keyboard tray includes a keyboard section for supporting a keyboard, and a mouse pad section for supporting a computer mouse.

12. The stand of claim 1 wherein said cabinet includes a top for supporting a computer monitor.

13. A portable utility stand for computer equipment comprising:

a stand having a pair of spaced opposed sides;

a main compartment adapted to receive a computer tower disposed in a lower part of said stand;

an auxiliary compartment disposed in an upper part of said stand above said main compartment;

a support tray assembly carried by said stand between said sides for supporting a computer keyboard;

a slidable generally planar base included in said tray assembly which slides relative to said stand;

a generally planar keyboard tray for supporting the keyboard rotatably carried by said slidable base so that said keyboard tray rotates on said base;

said keyboard tray having a stored position wherein said keyboard tray and base are generally longitudinally aligned and received within compartment and between said sides of said stand, and an operational position wherein said keyboard tray is withdrawn from said stored position between said sides and oriented in a generally horizontal position at a desired angle transverse of said base and said sides for keyboard operation; and said stand having a width less than a length of said keyboard tray, and a depth generally greater than the length of said keyboard tray.

14. The stand of claim 13 including a mount constructed and arranged to mount said keyboard tray on said base in a manner that said keyboard tray and base swivel and move in a straight-line relative to each other.

15. The stand of claim 14 wherein said keyboard tray includes a keyboard section for supporting a computer keyboard, and a mouse pad section for supporting a computer mouse; and said mount positioning said keyboard tray in a right-hand operational position wherein said mouse pad section is on the right side of said keyboard section, and said mount positioning said keyboard tray in a left-hand operational position which is rotated 180 degrees from said right-hand operational position wherein said mouse pad section is on the left of said keyboard section.

16. The stand of claim 14 including said mount includes an elongated slot formed in one of said keyboard tray and base and a swivel pin interconnecting said keyboard tray and base which is received in said elongated slot so that tray and base move in said straight-line and rotational movements.

* * * * *